United States Patent [19]

Berrey

[11] 4,023,483

[45] May 17, 1977

[54] TYPE FINGER IMPROVEMENT

[75] Inventor: Harry R. Berrey, Waynesboro, Va.

[73] Assignee: General Electric Company, Waynesboro, Va.

[22] Filed: Dec. 15, 1975

[21] Appl. No.: 640,721

[52] U.S. Cl. ..... 101/111; 101/93.14

[51] Int. Cl.[2] ..... B41J 1/20

[58] Field of Search ..... 101/93.14, 111, 105, 101/93.13

[56] References Cited

UNITED STATES PATENTS

| | | | |
|---|---|---|---|
| 3,605,613 | 9/1971 | DePuy et al. | 101/111 |
| 3,638,565 | 2/1972 | Drejza et al. | 101/111 |
| 3,667,384 | 6/1972 | Sniderman | 101/111 |
| 3,741,110 | 6/1973 | Bossi | 101/111 X |
| 3,760,719 | 9/1973 | Torrens et al. | 101/111 |
| 3,805,698 | 4/1974 | Bowers et al. | 101/111 |
| 3,844,211 | 10/1974 | Migoux et al. | 101/111 |

*Primary Examiner*—Edward M. Coven
*Attorney, Agent, or Firm*—Michael Masnik

[57] ABSTRACT

This invention relates to an improved design of removable type carrying fingers used in belt printer applications wherein a shoulder is provided on the fingers to fix the fingers with respect to the edge surface of the belt and the shoulder is located where the concentration of stresses developed at the shoulder during printing are compressive and not tensile.

3 Claims, 9 Drawing Figures

TYPE FINGER IMPROVEMENT

BACKGROUND OF THE INVENTION

The present invention relates to an improved design of type carrying fingers used in belt printer applications and particularly a design which minimizes the breakage of flexible type fingers during impact printing.

U.S. Pat. No. 3,605,610, filed June 4, 1968 by Earle B. McDowell, Clifford M. Jones and Seymour M. DePuy discloses a printing apparatus utilizing a type carrying belt that carrier a number of flexible fingers each of which has a type face for a particular character on one end thereof. U.S. Pat. No. 3,605,613, filed June 4, 1968 by Seymour M. DePuy and Donald G. Hebert discloses such a type carrying belt and the general design of the flexible type fingers. These type fingers are referably made of metallic material and have a shank provided with means for vertically positioning or locating the fingers within slots on the belt.

It will be appreciated that such type fingers must be designed with certain criteria in mind. For instance, the shank portion of the type finger must exhibit a degree of resilience and be rather accurately dimensioned. The type face portion must be suitable for continuous impacting without damage. Such type fingers when struck by hammers are caused to deflect and impact a record medium. During impact the fingers develop compression and tension stresses both due to deflection in response to the hammer force as well as edgewise bending or deflection due to friction forces developed at the point where the type face impacts the record medium while the belt continues its movement. The finger when exposed to repreated stresses over a long period of time, can develop cracks which lead to breakage and termination of finger life. With the trend to higher printing rates, a need has developed for improving the life of type fingers used in impact printing.

An object of the present invention is to provide improved type fingers capable of longer operation at high speeds.

Another object of this invention is to improve the life of flexible type fingers which are stressed during impact printing.

A further object of this invention is to minimize breakage of flexible fingers used in a belt printer.

A still further object of this invention is to provide fingers which can withstand the continuous stressing during impact printing while being provided with means for movably locating the type fingers in a type finger belt.

A further object of this invention is to minimize breakage which occurs at a shoulder provided on a flexible type finer to enable the finger to be locked in a position in the slots provided in a type finger carrying belt.

In accordance with a preferred embodiment of the invention, there is provided a removable type face carrying finger which can be inserted into a finger slot extending through the width of an elastic belt. The belt when rotated causes the inserted finger to be moved past a hammer where it can be struck to cause impact printing against the record medium. The finger comprises a substantially flat elongated member bearing a type face near one end thereof. The type finger is adapted to be inserted into one of the slots with the plane of its length and width substantially parallel to the plane of the belt. In order to fix the finger with respect to the edge surface of the belt nearest the type face, a shoulder is provided in the member extending orthogonally in the direction of the width of the finger and dimensioned to but the edge surface of the belt. The finger is made of flexible material and adapted to deflect in the direction substantially orthogonal to the plane of its width and length when struck by said hammer. The struck finger develops tension and compression stresses at the shoulder location on the member during impact by the finger against the record medium. To minimize breakage of the finger due to said stresses developed in the finger at said shoulder location, the shoulder is located on the trailing edge of the finger as defined by its movement by the belt past a hammer for impact printing. This corresponds to the region of the finger where the member is under compression.

The matters discussed above as well as further objects and features of the present invention will be more clearly understood and appreciated following a consideration of the accompanying drawings.

DETAILED DESCRIPTION OF THE INVENTION

Figure 1:
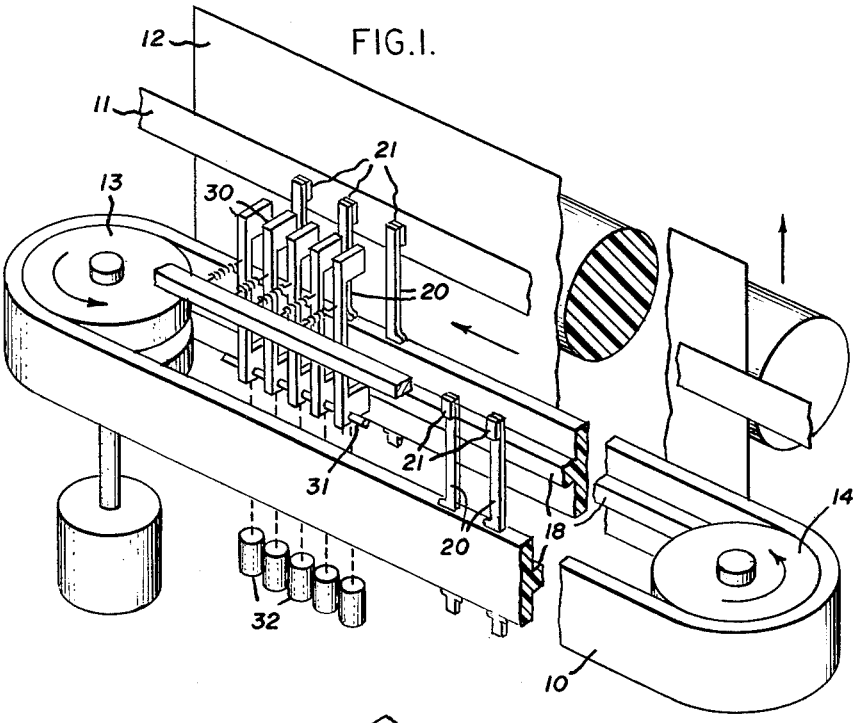
FIG. 1 illustrates schematically a printing mechanism employing removable type fingers.

The perspective sketch of FIG. 1 illustrates the principal components of an impact printing apparatus of the type shown in the aforecited U.S. Pat. No. 3,605,610. This sketch shows a type carrier or belt 10 adapted to be driven at a constant speed around pulleys or reels 13, 14 in a counterclockwise direction as viewed from above. The direction of movement of the belt 10 relative to a record medium 12 is such that it traverses a line of print on the record medium. Interposed between type carrier 10 and the record medium 12 is an inking ribbon 11. It will be understood that any suitable material may be used for recording medium 12 and inking ribbon 11. Type carrier 10 carries a plurality of flexible type fingers 20 which are attached to the belt 10 and extend through it at precisely located positions. At the upper external end of the flexible fingers, a type face 21 is provided for cooperation with the ribbon 11 in order to impress particular characters on the recording medium. Fingers 20 are preferably equally spaced along the length of the belt. Only a few typical fingers are shown in the sketch. One or more complete fonts of type formed characters may be provided and as exlained hereinafter, the particular characters may be changed by changing the fingers 20. They may take the form of numerals, letters, marks or other symbols in accordance with the desire of the particular users.

A row of hammers 30 is disposed across the entire usable width of the record medium 12, a separate hammer being provided for each position at which a character may be printed on the recording medium. The hammers are located behind the type carrier 10 and are controlled by circuitry to move forward when a character is to be impressed on the record medium. The hammer is designed to strike a finger 20 and drive it into ribbon 11 and the surface of recording medium 12. The fingers are formed of material highly resistant to taking a set. A plurality of electromagnets 32 is illustrated to show the general method of actuating hammers 30. It will be understood that the hammers pivot about an axis 31 and spring means not shown are provided for returning them to the position shown. As previously noted, as the type carrier 10 moves at a continuous velocity across the face of the record medium, hammers 30 are selectively actuated to impress the various characters at desired locations on the record medium. As a result of each hammer impact, the flexible fingers are urged in the direction transverse the motion of the belt and into the ribbon and recording medium and they must return in time to permit the possible subsequent impacting of a succeeding hammer. The dynamic characteristics required to satisfactorily permit this functioning place stringent requirements on the design of the type carrier belt and the fingers employed with it.

Figure 2:
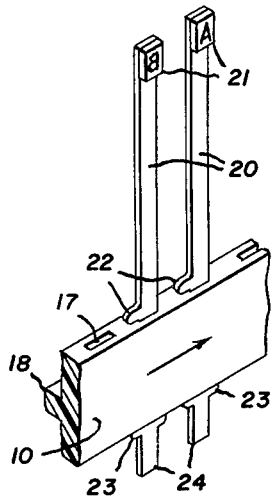
FIG. 2 illustrates how the fingers are provided with a shoulder to facilitate proper location of the removable finger within the belt.

A more complete understanding of the specific features of the invention will be available upon consideration of FIG. 2 which illustrates a short segment of belt in an enlarged and somewhat exaggerated form. This segment illustrates two flexible finger members 20 properly mounted in the belt 10. It also shows a slot 17 as it appears prior to insertion of a flexible finger. Fingers 20 are preferably made of metallic material and are provided with upper and lower shoulder portions 22 and 23 respectively. The belt itself is made of an elastic material such as urethane or the like. In order to insert a type finger 20 into the belt 10, the lower portion 24 is simply forced through a preformed slot 17 and the lower shoulder 23 acts to expand the slot as the finger traverses it. When the finger member is in the correct position, upper shoulder 22 and lower shoulder 23 reside on the upper and lower surfaces of the belt respectively. The shoulders maintain the alignment of the type along a desired line by assuring the rigid, vertical positioning of the fingers and restraining the fingers within their respective slots until sufficient pressure is applied to purposely remove the fingers from their position.

The upper portion of each finger 20 carries a type face 21. These type faces may be fastened to or formed as an integral part of the upper portion of the fingers.

By using polyurethane as the elastic material for the body 10 of the carrier belt, it is possible to manufacture the belt by casting techniques. Thus, the belt is cast having the desired peripheral dimensions and including an interprojecting portion 18 for engagement with the pulley means 13 and 14 that drive the belt so that the type fingers can traverse a line on a record medium.

Figure 3:
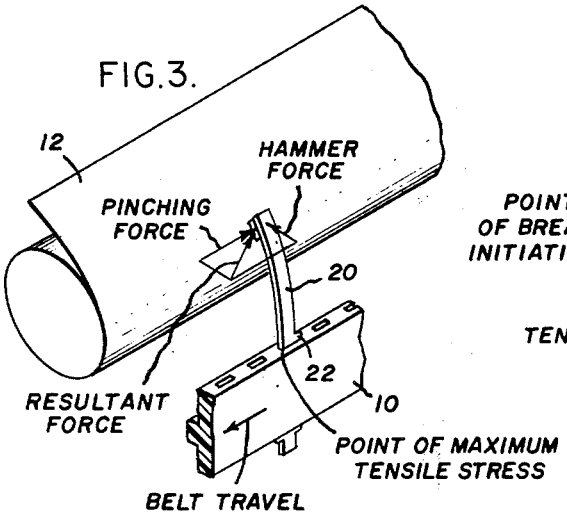
FIG. 3 illustrates schematically and diagramatically the stres forces developed on the finger during impact printing.
Figure 4:
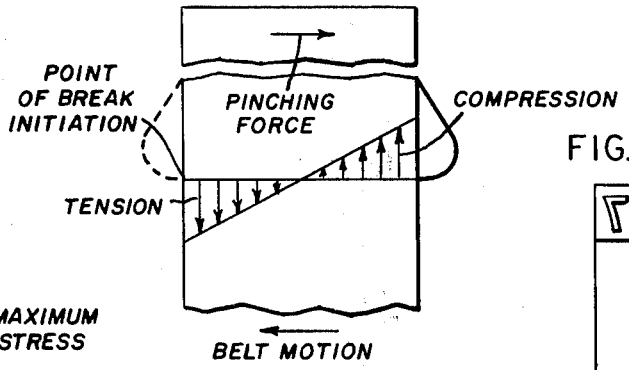
FIG. 4 is a stress diagram illustrating the various forces developed at the shoulder location.

Reference is now made to FIG. 3 for discussion of the principal forces involved in developing the tension and compression stresses developed at the location where the type finger enters the belt and where the positioning shoulder 22 is located. The forces acting at the point where the type face impacts the record medium is the hammer force due to hammers striking the type finger and drving it forward into the record medium and the pinching force resulting from the fact that the type finger is moving in the direction of belt travel while the portion of the type finger containing the type face is in impact contact with the record medium. The result is that the type finger is caused to bend edgewise opposite the direction of travel as the result of the resultant force developed by the hammer striking the type finger and the pinching force developed when the type face impacts the stationary record medium. FIG. 4 illustrates that for the belt motion indicated and the pinching force developed upon impact, the leading edge of the type finger is stressed in tension while the trailing edge is stressed in compression. Under the circumstances, if a discontinuity is provided in the type finger in the vicinity where the tension and compression stresses are maximum, this discontinuity becomes a site now for possible finger cracking and rupturing due to fatigue failure. Under the circumstances where it is necessary to provide a shoulder such as 22 shown in FIG. 2 to the finger in order to help locate it and position it fixedly within the belt, this shoulder introduces sufficient discontinuity in the type finger structure to provide a point of rupture when exposed to the tension stresses described. Experience shows that flexible material such as a type finger made of maraging steel is more susceptible to rupture when exposed to tension stresses. An example of such maraging steel is that marketed by Allegheny Ludlum Steel Corporation under designation ALMAR 18, ALMAR 20 and ALMAR 25 steel. These are high nickel, martensitic steels which exhibit high strength and hardness suitable for type finger applications. The properties of maraging steel are explained in detail in a 1962 copyrighted publication of Allegheny Ludlum Steel Corporation entitled "ALMAR". Accordingly, in accordance with the present invention a shoulder is provided on the type finger for positioning and locking purposes on the edge of the type finger exposed to compression. This corresponds to the trailing edge of the type finger when referenced against the direction of belt motion. Since the type finger material can withstand greater compression than tension, the result is a type finger provided with the shoulder for locating or locking purposes with minimum opportunities for breakage of the flexible type finger due to edge bending caused by the pinching forces when the type finger impacts the record medium.

Figure 7:
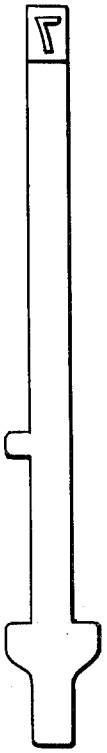
FIG. 7 illustrates in greater detail the shoulders provided on a type finger to facilitate location within an elastic belt carrier.
Figure 5A:
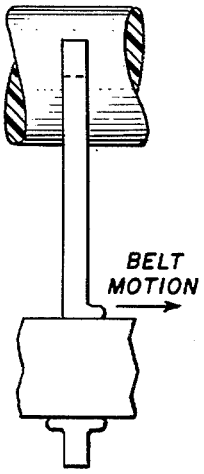
FIGS. 5A and 5B represent the back and side views of the finger under the condition finger has not been impacted against the paper.
Figure 5B:
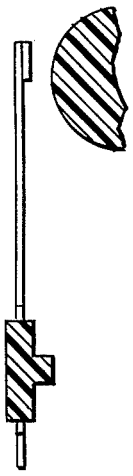
Figure 6A:
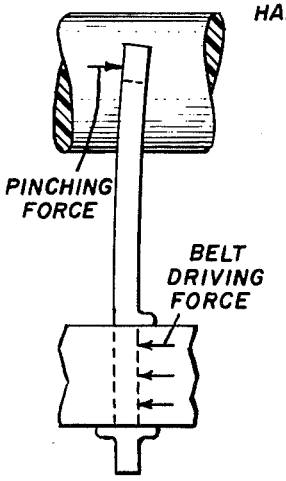
FIGS. 6A and 6B illustrate the back and side views of the finger under the condition when the type finger impacts the record medium.
Figure 6B:
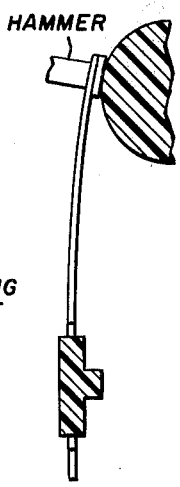

Referring to FIG. 5, there is shown a back view and side view of the type finger before impact. Under the circumstances, no forces are shown being developed which could lead to stresses in the type finger. FIG. 6 shows, however, that upon contact of the type finger with the record medium, a pinching force is developed at the type face in response to the hammer holding the type face against the record medium. The belt continues to move the type finger even during the impact period when the hammer is contacting the type face. This motion of the supported end of the finger while the motion of the end of the finger is temporarily arrested, causes a stress in the leading edge of the finger in the vicinity of the emergence of the type face carrying end of the finger from the slot in the belt. FIG. 7 illustrates in greater detail the pair of shoulders used at the bottom to align the type finger with the bottom edge of the belt and the single shoulder located on the trailing edge of the type finger for aligning the finger with respect to the top edge of the belt.

The embodiment disclosed and discussed here and above may be modified by those skilled in the art. It is contemplated in the appended claims to include all such modifications which come within the spirit and scope of the teachings herein.

What I claim as new and desire to secure by Letters Patent of the United States is:

1. A type face carrying finger for use in an elastic belt type carrier which moves the finger across a record medium for impact printing thereon wherein the elastic belt comprises a plurality of slots extending through the width of said belt transversely of the longitudinal axis of said belt and spaced to precise predetermined locations, each of said type face carrying fingers adapted to be supported in respective ones of said slots, each of said fingers comprising a substantially flat elongated member, said finger being resilient in a direction substantially orthogonal to the longitudinal axis of said belt and bearing a type face on a flat surface at one end thereof, each of said type fingers comprising a first shoulder extending in the width direction of the finger and dimensioned to abut the one edge surface of said belt nearest said type face for fixing the finger with respect to said one edge surface of said belt and a pair of shoulders spaced from said first shoulder by substantially the width of said belt and extending in both directions in the width direction of the finger and dimensioned to abut the other edge surface of said belt for facilitating the insertion and removal of said type finger and to secure said finger in said belt between said first and second shoulders, means for minimizing breakage of said fingers due to stresses developed along the width direction of said fingers in the vicinity of said one edge surface of said belt due to pinching of the finger at its one end against the record medium during impact printing comprising locating said first shoulder on said finger only where the concentration of stresses developed at said shoulder are compressive and not tensile,

2. A removable type face carrying finger for insertion into finger slots extending through the width of an elastic belt which moves the inserted finger continuously along a path past a hammer and across a record medium for impact printing on said record medium upon hammer actuation, where said finger comprises a substantially flat elongated member bearing a type face near one end thereof, said member being resilient, said member adapted when inserted into one of said slots with the plane of its length and width substantially parallel to the path of movement of said finger and struck by said hammer, to deflect in a direction substantially orthogonal to said plane of said finger, means for fixing said finger with respect to one edge surface of said belt nearest said type face while minimizing breakage of said finger due to bending stresses developed in said finger in its width direction in the vicinity of emergence of the type face carrying end of said finger from the slots in said belt carrier during impact by said finger against said record medium comprising providing a shoulder on the trailing edge of said finger and not on the leading edge of said finger as defined by its movement by the belt past a hammer for impact printing and extending in the width direction of said finger and dimensioned to abut said one edge surface of said belt.

3. A removable face carrying finger for insertion into finger slots extending through the width of an elastic belt which moves the inserted finger along a path past a hammer and across a record medium for impact printing against said record mdium upon actuation of the hammer, wherein said finger comprises a substantially flat, elongated member bearing a type face near one end thereof, said member being resilient and when inserted into one of said slots with the plane of its length and width substantially parallel to said path of movement, said finger adapted to deflect in a direction substantially orthogonal to the plane of its length and width when struck by said hammer, said struck finger developing tension and compression stresses during impact printing having a maximum in the vicinity of the emergence of the finger from a slot in the belt, during the impact period when said finger is pinched against said record medium by a hammer, means for fixing said finger with respect to the edge surface of said belt nearest said type face without increasing said maximum tensile stresses comprising a shoulder extending in the width direction of said finger and dimensioned to abut said edge surface of said belt on the trailing edge of said finger, as defined by its movement by the belt past a hammer for impact printing, and providing a continuously smooth leading edge on said finger to uniformly distribute the tensile stresses along said leading edge.

* * * * *